US009329517B2

(12) United States Patent
Morgan

(10) Patent No.: US 9,329,517 B2
(45) Date of Patent: May 3, 2016

(54) DRIVE RECEIVING MEMBER FOR AN IMAGING CARTRIDGE

(71) Applicant: Clover Technologies Group, LLC, Ottawa, IL (US)

(72) Inventor: John Morgan, Newbury Park, CA (US)

(73) Assignee: CLOVER TECHNOLOGIES GROUP, LLC, Ottawa, IL (US)

( * ) Notice: Subject to any disclaimer, the term of this patent is extended or adjusted under 35 U.S.C. 154(b) by 0 days.

(21) Appl. No.: 14/501,307

(22) Filed: Sep. 30, 2014

(65) Prior Publication Data

US 2016/0091815 A1 Mar. 31, 2016

(51) Int. Cl.
*G03G 15/00* (2006.01)
*G03G 21/18* (2006.01)

(52) U.S. Cl.
CPC ..... *G03G 15/00* (2013.01); *G03G 21/1857* (2013.01)

(58) Field of Classification Search
CPC ..... G03G 15/0896; G03G 15/757; G03G 21/1857; G03G 21/1647
USPC ..... 399/110, 167
See application file for complete search history.

(56) References Cited

U.S. PATENT DOCUMENTS

| | | | | |
|---|---|---|---|---|
| 7,885,575 | B2 | 2/2011 | Batori et al. | |
| 8,121,517 | B2 | 2/2012 | Asanuma et al. | |
| 8,135,304 | B2 | 3/2012 | Abe et al. | |
| 8,280,278 | B2 | 10/2012 | Ueno et al. | |
| 8,433,219 | B2 | 4/2013 | Miyabe et al. | |
| 8,437,669 | B2 | 5/2013 | Morioka et al. | |
| 8,615,184 | B2 | 12/2013 | Zhou et al. | |
| 2010/0272470 | A1* | 10/2010 | Tomatsu | G03G 21/1647 399/167 |
| 2011/0217073 | A1 | 9/2011 | He | |
| 2011/0255900 | A1* | 10/2011 | Zhou | G03G 21/186 399/111 |
| 2012/0275824 | A1 | 11/2012 | Gu et al. | |
| 2014/0153968 | A1 | 6/2014 | Huck et al. | |

FOREIGN PATENT DOCUMENTS

| | | |
|---|---|---|
| CN | 102193359 | 9/2011 |
| CN | 202067076 | 12/2011 |
| CN | 202710923 | 1/2013 |
| CN | 202710931 | 1/2013 |
| CN | 202886848 | 4/2013 |
| CN | 202886849 | 4/2013 |
| CN | 202886850 | 4/2013 |
| CN | 103513534 | 1/2014 |
| CN | 103576524 | 2/2014 |
| EP | 2495619 | 9/2012 |
| JP | 04014057 A | 1/1992 |
| WO | WO2011091686 | 8/2011 |

* cited by examiner

*Primary Examiner* — Walter L Lindsay, Jr.
*Assistant Examiner* — Jessica L Eley
(74) *Attorney, Agent, or Firm* — Mathew G. Gavronski

(57) ABSTRACT

A drive receiving member for transferring rotational driving force from an image forming apparatus to components of an imaging cartridge is provided. A distal end of the member includes at least one substantially rigid drive lug for receiving rotational driving force from the imaging device. In some constructions the distal end also includes at least one catch member extending beyond the drive lug to facilitate movement of the coupling member from a retracted position to an extended position when the cartridge is installed in the imaging device. In other constructions, an actuator may be provided to initiate movement of the coupling member from the extended position to a retracted position during removal of the cartridge from the imaging device.

24 Claims, 7 Drawing Sheets

DRIVE RECEIVING MEMBER FOR AN IMAGING CARTRIDGE

BACKGROUND

The present disclosure relates to consumable cartridges used in image forming apparatuses, and more specifically to drive receiving components for such cartridges.

Aftermarket suppliers of imaging consumables, such as toner cartridges for imaging devices, configure their cartridges to be compatible with the drive mechanisms provided on the OEM devices. In many instances, suppliers of aftermarket consumable cartridges modify their cartridges to be different from OEM cartridges, for example to increase page yield, to make cartridges compatible with additional or different imaging devices, to improve performance with other non-OEM components (such as toner), and the like.

SUMMARY

In some aspects, a drive receiving member for transferring rotational driving force from an image forming apparatus to components of an imaging cartridge is provided and includes a central portion defining an axis, a plane extending through the central portion substantially perpendicular to the axis, and a distal end for receiving rotational driving force. The distal end includes at least one substantially rigid drive lug defining a drive-receiving surface and including a drive lug end positioned a first axial distance from the plane, and at least one resilient catch member including a catch member end positioned a second axial distance from the plane. The second axial distance is greater than the first axial distance.

The at least one substantially rigid drive lug of the member optionally may include a pair of substantially diametrically opposed substantially rigid drive lugs, and the drive lug end of each of the pair of drive lugs may be positioned the first axial distance from the plane. In other aspects, the at least one resilient catch member may include a pair of substantially diametrically opposed resilient catch members, and the catch member end of each of the pair of catch members may be positioned the second axial distance from the plane. The central portion of the member may include an axially facing retention surface that defines the plane. The retention surface may receive a biasing force that biases the drive receiving member axially toward the distal end. The catch member may be circumferentially-spaced from the drive-receiving surface. The drive receiving member may further include a proximal end including a radially outwardly extending projection defining a drive-transmitting surface. The drive lug of the coupling member may include a drive lug base and the catch member may include a catch member base, and the drive lug base and the catch member base may be spaced a third axial distance from the plane.

In still other aspects, a drive receiving assembly for transferring rotational driving force from an image forming apparatus to components of an imaging cartridge includes a generally cylindrical flange member defining an axis, and an elongated coupling member coupled to the flange member for axial movement with respect thereto between an extended position and a retracted position. The coupling member includes a distal end having a substantially rigid drive lug extending a first axial distance away from the flange member and a resilient catch member extending a second axial distance away from the flange member. A biasing member is positioned between the flange member and the coupling member and biases the coupling member toward the extended position.

The coupling member may optionally include a proximal end including a radially outwardly extending projection defining a drive-transmitting surface. The flange member may include a drive dog, and the drive-transmitting surface may engage the drive dog to transfer rotational driving force from the coupling member to the flange member. The coupling member may be rotatable about the axis relative to the flange member between a first rotational position and a second rotational position. The assembly may further comprise a cam surface for regulating movement of the coupling member relative to the flange member such that when the coupling member is moved from the first rotational position to the second rotational position the coupling member moves from the retracted position to the extended position. The cam surface may include a detent portion detently securing the coupling member in the first rotational position and in the retracted position. In one optional aspect, when the detent portion is overcome, the biasing member may move the coupling member to the extended position. In another optional aspect, the cam surface may include a flat portion that affords a limited range of rotational movement between the coupling member and the flange member while the coupling member is in the extended position. In some constructions the cam surface may be provided on the flange member. The coupling member may include a pin member that rides along the cam surface during movement of the coupling member from the first rotational position to the second rotational position.

In still other aspects, a drive receiving assembly for transferring rotational driving force from an image forming apparatus to components of an imaging cartridge includes a flange defining an axis and including an outer diameter defining an imaginary cylinder extending in the axial direction. A coupling member is coupled to the flange for axial movement with respect to the flange between an extended position and a retracted position. An actuator is located within the imaginary cylinder and is operable to initiate movement of the coupling member from the extended position toward the retracted position.

The assembly optionally may further include a biasing member biasing the coupling member toward the extended position. The coupling member may be rotatable about the axis relative to the flange member between a first rotational position and a second rotational position. The assembly may further include a cam surface for regulating movement of the coupling member relative to the flange member such that when the coupling member is moved from the second rotational position to the first rotational position the coupling member moves from the extended position to the retracted position. In one optional aspect, the actuator is a rotary actuator that rotates the coupling member from the second rotational position to the first rotational position, thereby overcoming the biasing member and moving the coupling member from the extended position to the retracted position. In another optional aspect, the actuator is operable to move the coupling member between the extended position and the retracted position. The assembly may further comprise a trigger engageable with a portion of the image forming apparatus, wherein the trigger activates the actuator upon disengagement from the portion of the image forming apparatus.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting.

DETAILED DESCRIPTION

Figure 1:
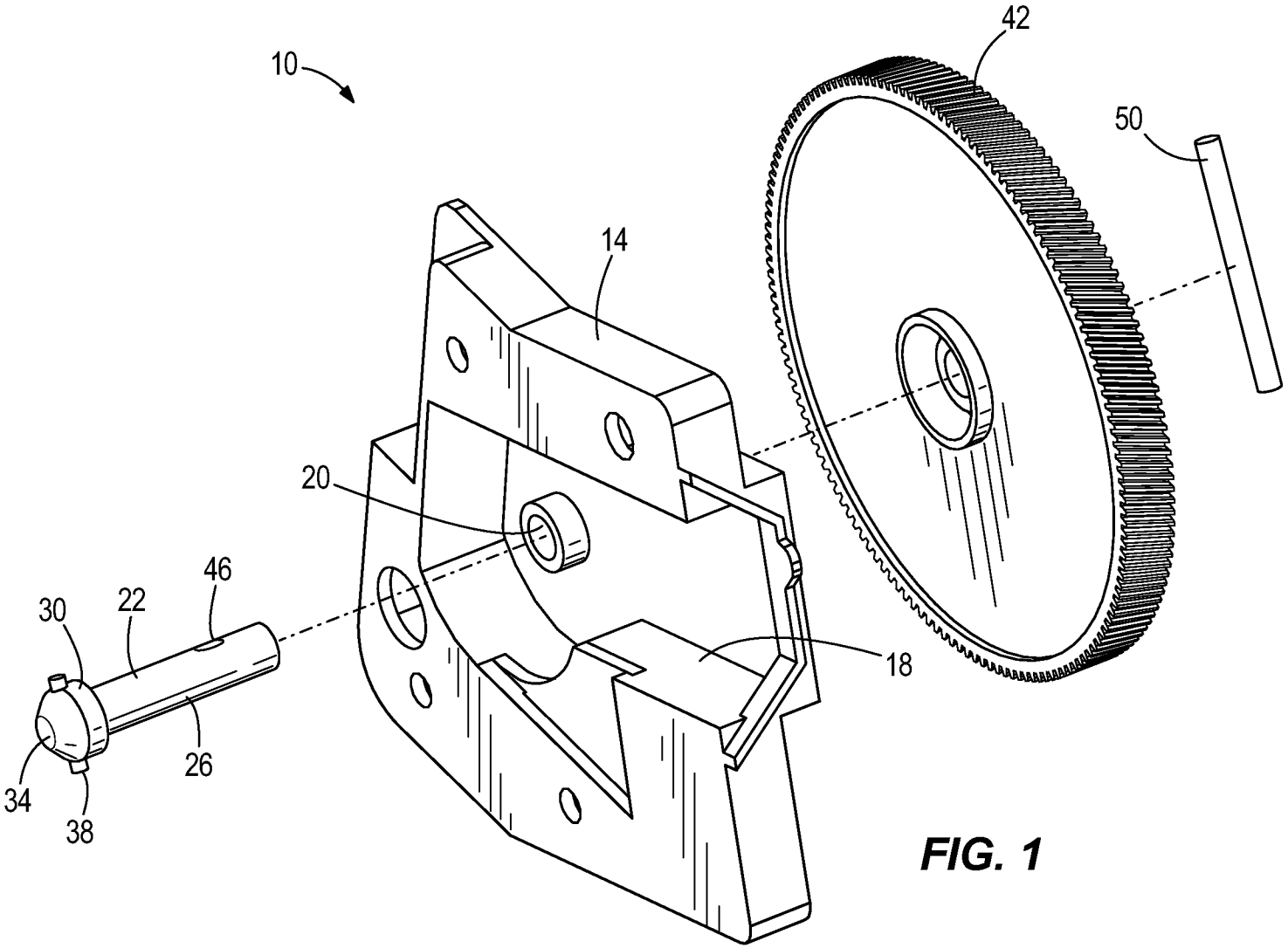
FIG. 1 is an exploded perspective view of an OEM printer drive system.

FIG. 1 illustrates an OEM printer drive system 10 for a laser printer. The system 10 includes a housing portion 14 that defines a cartridge receiving slot 18. An opening 20 is provided adjacent an end of the slot 18 and is adapted to receive a printer drive pin 22. The drive pin 22 includes a shaft portion 26 that extends through the opening 20 and a head portion 30 that extends into the slot 18 and that is positioned for engagement with the drive-receiving part of a suitably configured toner cartridge. The head portion 30 includes a generally conical end portion 34 and a pin member 38 located generally at the base of the conical end portion 34 and extending through the head portion 30 substantially transverse to the drive pin 22 longitudinal axis. The shaft portion 26 extends through opening 20 and beyond the housing portion 14 for coupling with a drive gear 42. The shaft portion 26 includes a transverse bore 46 that receives a coupling pin 50 that drivingly couples the drive pin 22 with the drive gear 42 such that rotation of the drive gear 42 via printer motor rotates the drive pin 22.

Figure 2:
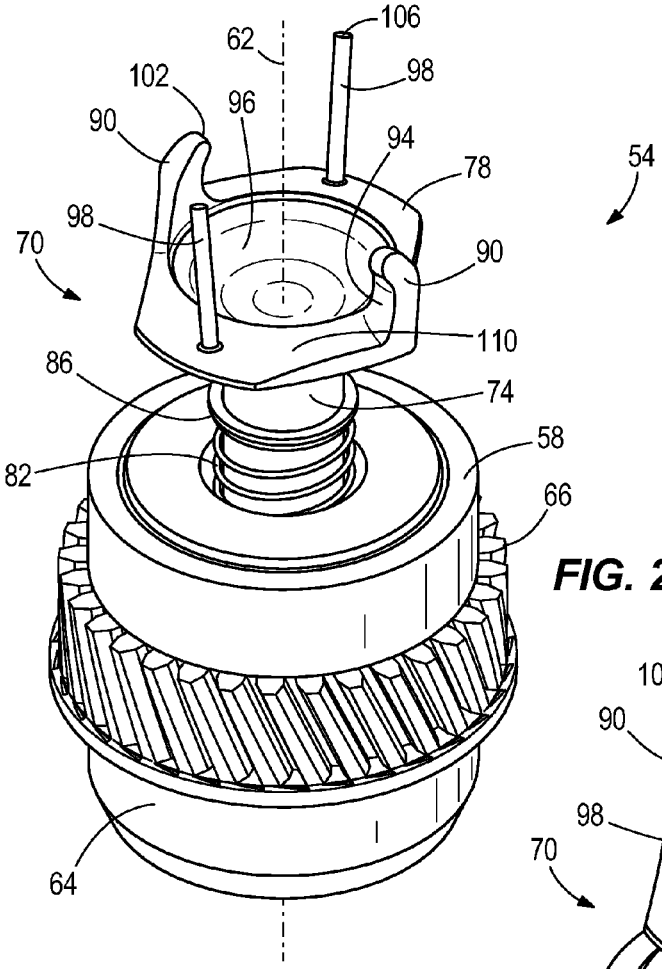
FIG. 2 is a perspective view of a drive receiving assembly according to one exemplary embodiment with a coupling member in an extended or drive-engaging position.
Figure 3:
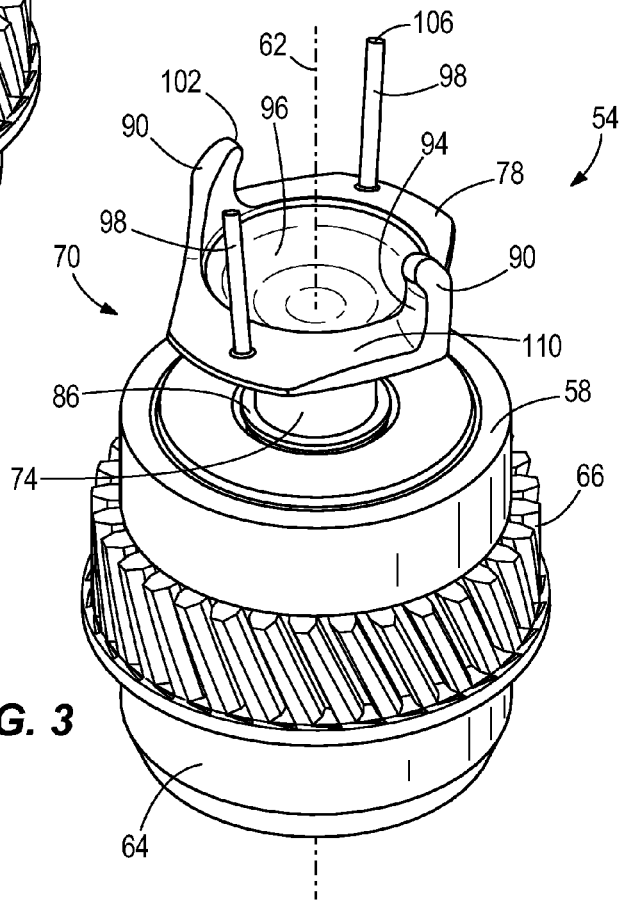
FIG. 3 is a perspective view of the drive receiving assembly of FIG. 2 with the coupling member in a retracted or drive-disengaging position.

Referring also to FIGS. 2 and 3, a drive receiving assembly 54 is adapted for engagement with the printer drive system 10 of FIG. 1. The assembly 54 includes a generally cylindrical flange member 58 defining a central axis 62. The flange member 58 includes an insert portion 64 and a gear portion 66. The flange member 58 receives a coupling member 70 that includes a proximal end or inner portion 74 received by the flange member 58 and a distal end or outer portion 78 configured for driving engagement with the drive pin 22. The coupling member 70 is mounted for axial movement relative to the flange member 58 between an extended position (FIG. 2) and a retracted position (FIG. 3). The coupling member 70 is also movable relative to the flange member 58 through a limited range of rotational movement, as discussed further below.

A biasing member in the form of a spring 82 biases the coupling member 70 toward the extended position. The illustrated spring 82 surrounds the inner portion 74 of the coupling member 70 and is captured between an inner surface (not shown) of the flange member 58 and a retention surface 86 provided on the coupling member 70. In other embodiments, the spring 82 may be positioned within a cylindrical cavity formed on the interior of the coupling portion 70. In the illustrated configuration, the retention surface 86 is defined by a snap ring or E-clip that fits into a circumferential groove formed in the inner portion 74 of the coupling member 70. In other configurations the retention surface 86 may be integrally formed with the coupling member.

The outer portion 78 of the coupling member 70 includes a pair of diametrically opposed drive lugs 90. Each drive lug 90 includes a drive-receiving surface 94 configured to receive rotational driving force from the pin member 38 of the drive pin 22. In the illustrated configuration the drive lugs 90 are integrally formed of metal along with the remainder of the coupling member 70. While steel or aluminum alloys are preferred, plastics, ceramics, or other materials having suitably rigid material properties capable of transmitting the drive forces received from the drive pin 22 may also be used. A concave recess 96 is provided between the drive lugs 90 and is adapted to at least partially receive the conical end portion 34 of the drive pin 22. In some configurations, the inclined surfaces of the concave recess 96 and the conical end portion 34 may cooperate with one another to facilitate movement of the coupling member 70 toward the retracted position during removal of the cartridge from the printer.

Figure 4:
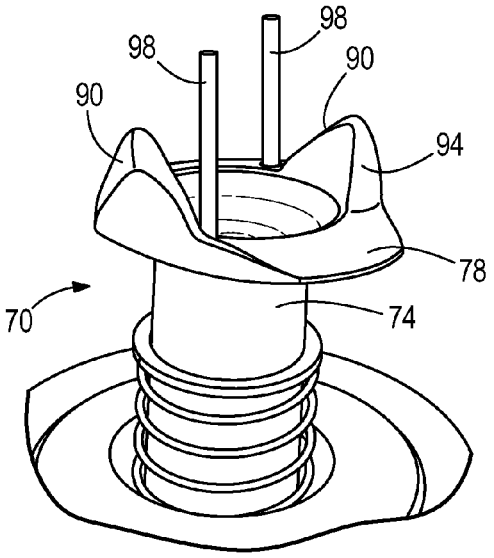
FIG. 4 is a perspective view of an alternative embodiment of the coupling member.

The outer portion 78 also includes a pair of diametrically opposed resilient catch members 98. The catch members 98 are configured for engagement with the pin member 38 of the drive pin 22 during engagement of the coupling member 58 with the drive pin 22, as discussed below. After the coupling member 58 is fully engaged with the drive pin 22, the pin member 38 engages the drive lugs 90. The catch members 98 may be formed from plastic or another suitably resilient material. In the embodiment of FIGS. 2 and 3, the catch members 98 are circumferentially spaced approximately 90 degrees from the drive lugs 90. The relative location of the catch members 98 and the drive lugs 90 may differ in other embodiments. For example, in the embodiment of FIG. 4, each catch member 98 is positioned adjacent an associated drive lug 90 on a side of the drive lug 90 opposite the engagement surface. In other embodiments, the catch members 98 may extend from a portion of a respective drive lug 90. Although the illustrated catch members 98 are shown extending in a generally axial direction, the catch members 98 may also be angled to extend both axially and circumferentially in either a clockwise or counter-clockwise manner.

Figure 5:
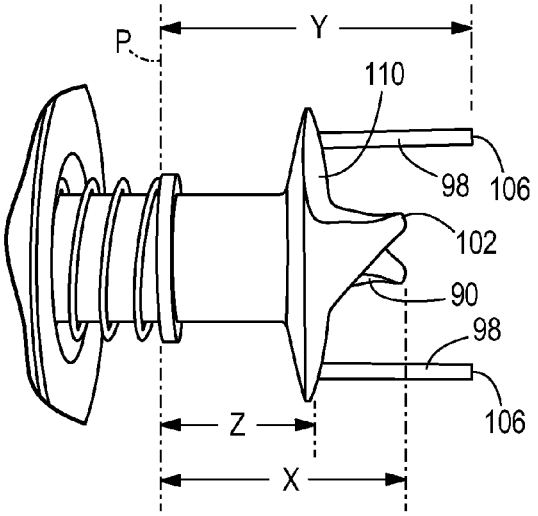
FIG. 5 is a side view of the coupling member of the drive receiving assembly of FIG. 2.

Referring also to FIG. 5, the catch members 98 are seen to extend further in the axial direction than the drive lugs 90. More specifically, if the retention surface 86 is used to define a reference plane P, drive lug ends 102 are spaced a first distance X from the plane P, and catch member ends 106 are spaced a second distance Y from the plane P, with the second distance Y being greater than the first distance X. In the illustrated embodiment, both the drive lugs 90 and the catch members 98 extend from a generally axially facing surface 110 that is spaced a third distance Z from the plane P. As a result, the bases of the drive lugs 90 and the bases of the catch members 98 are both spaced substantially the third distance Z from the plane. In other embodiments the bases of the drive lugs 90 and the bases of the catch members 98 may be offset from one another, individually or as pairs, such that the bases of the drive lugs 90 and catch members 98 are located different distances from the plane P.

Figure 6:
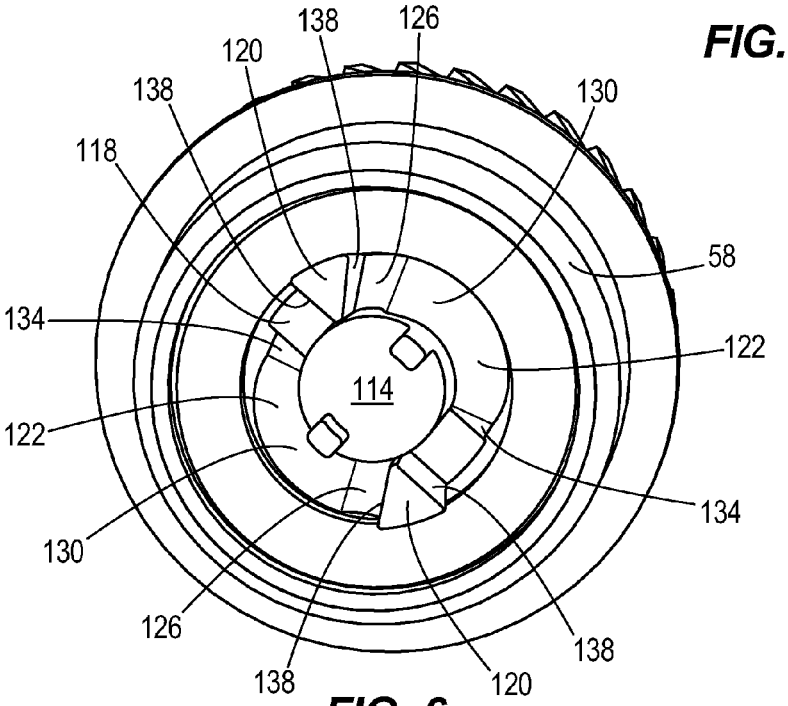
FIG. 6 is a bottom view of the drive receiving assembly of FIG. 2.

Referring also to FIG. 6, the inner portion 74 of the coupling member 70 includes a proximal end 114 that, in the illustrated embodiment, includes a pin 118 extending transversely therethrough. The pin 118 defines a pair of radially outwardly extending projections that define drive-transmitting surfaces. Ends of the pin 118 each abut a respective drive dog 120 provided on the interior of the flange member 58 to receive driving rotational force such that rotation of the coupling member 70 rotates the flange member 58. In other embodiments, the pin 118 or pin-like projections maybe integrally formed as part of the coupling member 70.

In the illustrated embodiment, the interior of the flange member 58 defines a cam surface 122 for controlling movement of the pin 118 as the coupling member 70 moves between the extended and retracted positions. More specifically, the cam surface 122 functions to couple and control axial and rotational movement of the coupling member 70 relative to the flange member 58 such that when the coupling member moves from the retracted position to the extended position, the coupling member 70 rotates from a first rotational position relative to the flange member 58 to a second rotational position relative to the flange member 58. Similarly, when the coupling member 70 rotates from the second rotational position to the first rotational position, the coupling member 70 moves from the extended position to the retracted position. The spring 82 functions to maintain the pin 118 in engagement with the cam surface 122 during movement of the coupling member 70 relative to the flange member 58.

In the illustrated configuration the cam surface 122 is comprised of two substantially identical halves, with each half receiving one end of the pin 118. The cam surface 122 may be formed integrally with the other portions of the flange member 58, may be formed in one or more separate pieces that are coupled to the flange member 58, or may be formed as part of the coupling member 70, in which case the flange member 58 may be provided with projections similar to those defined by the ends of the pin 118. As discussed further below, the cam surface 122 may be eliminated in some embodiments where movement of the coupling member 70 relative to the flange member 58 is controlled in other ways.

Figure 7:
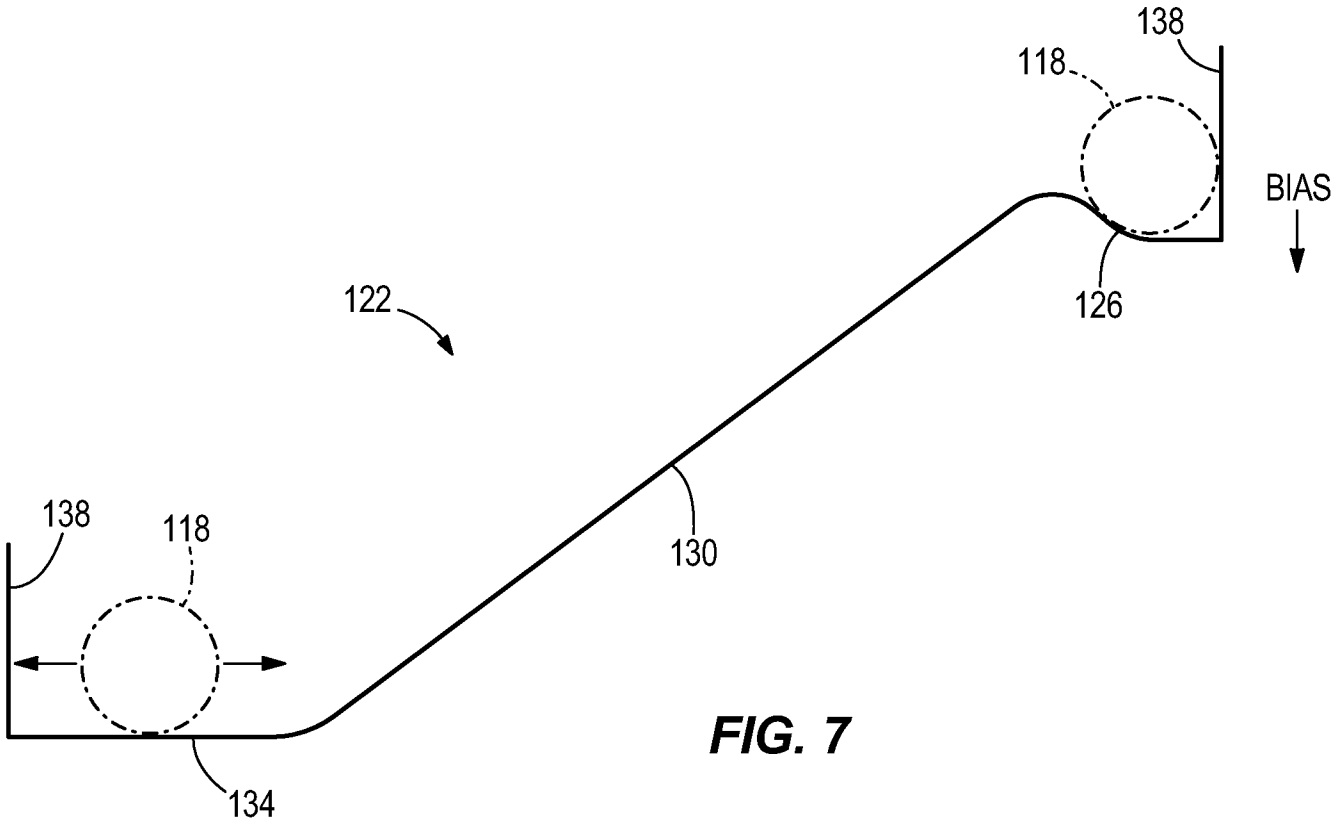
FIG. 7 is a schematic representation of a cam profile for regulating movement of the coupling member between the extended and retracted positions.

Referring also to FIG. 7, which schematically illustrates one half of the cam surface 122, the illustrated exemplary cam surface 122 includes a detent portion 126, a ramp portion 130, and a flat portion 134. Opposite sides of the drive dog 120 define stop surfaces 138 associated with the detent portion 126 and the flat portion 134 for limiting rotational movement of the coupling member 70 relative to the flange member 58. When the pin 118 is in the detent portion 126 the coupling member 70 is in the retracted position and the first rotational position, and the pin 118 is urged into contact with the stop surface 138 due to the geometry of the detent portion 126 and the biasing force provided by the spring 82, which urges the pin 118 in a downward direction as indicated by the arrow in FIG. 7. Rotating the coupling member 70 away from the first rotational position overcomes the biasing force of the spring 82 and moves the pin 118 out of the detent portion 126 and onto the ramp portion 130. When the pin 118 is on the ramp portion 130 the biasing force of the spring 82 moves the coupling member 70 toward the extended position while the ramp portion 130 of the cam surface 122 causes the coupling member 70 to rotate toward the second rotational position. When the pin reaches the flat portion 134 of the cam surface 122, the coupling member 70 is in the extended position and can be rotated through a relatively small rotational angle between the second rotational position—in which the pin 118 is engaged with the stop surface 138—and a third rotational position at which the pin 118 engages the ramp portion 130 such that further rotation of the coupling member 70 will cause the coupling member 70 to begin moving toward the retracted position.

In one exemplary form of operation, the drive receiving assembly 54 is installed in a print cartridge with the pin 118 located in the detent portion 126 such that the coupling member 70 is in the retracted position and in the first rotational position. When the print cartridge is installed into a printer having the drive system 10 of FIG. 1, the drive lugs 90 are axially spaced away from the pin member 38 of the drive pin 22, while the catch members 98 overlap in the axial direction with the pin member 38 of the drive pin 22. The rotational force required to rotate the components of the print cartridge is greater than the rotational force required to rotate the coupling member 70 with respect to the flange member 58. Thus, when the drive system 10 operates, the pin members 38 engage the catch members 98, which in turn rotate the coupling member 70 relative to the flange member 58 and cause the pin 118 to move out of the detent portion 126 of the cam surface 122 and onto the ramp portion 130 of the cam surface 122.

Once the pin 118 is moved out of the detent portion 126, the spring 82 moves the coupling member 70 to the extended position while the ramp portion 130 causes the coupling member 70 to rotate toward the second rotational position. As the coupling member 70 moves to the extended position the drive lugs 90 are axially shifted into alignment with the pin member 38 of the drive pin 22. When the pin 118 engages the stop surface 138 in the flat portion 134 of the cam surface 122, further relative rotation between the coupling member 70 and the flange member 58 is substantially prevented. Although the resilient catch members 98 are sufficiently rigid to cause rotation of the coupling member 70 with respect to the flange member 58, they are insufficiently rigid to rotate the components of the print cartridge, which as noted above requires greater rotational force than rotating the coupling member 70 with respect to the flange member 58. Accordingly, when the pin 118 engages the stop surface 138 in the flat portion, further rotation of the drive pin 22 causes deformation of the resilient catch members 98 until the pin members 38 disengages from the catch members 98. Further rotation of the drive pin 22 then moves the pin members 38 into engagement with the drive receiving surfaces 94 of the drive lugs 90, which are sufficiently rigid to transfer the rotational force received via the drive pin 22 to the print cartridge components by way of the coupling member 70, pin 118, drive dogs 120 and flange member 58. The cartridge is thereafter operated via the rotational driving force transmitted from the printer drive system 10 by way of the drive assembly 54.

Figure 8:
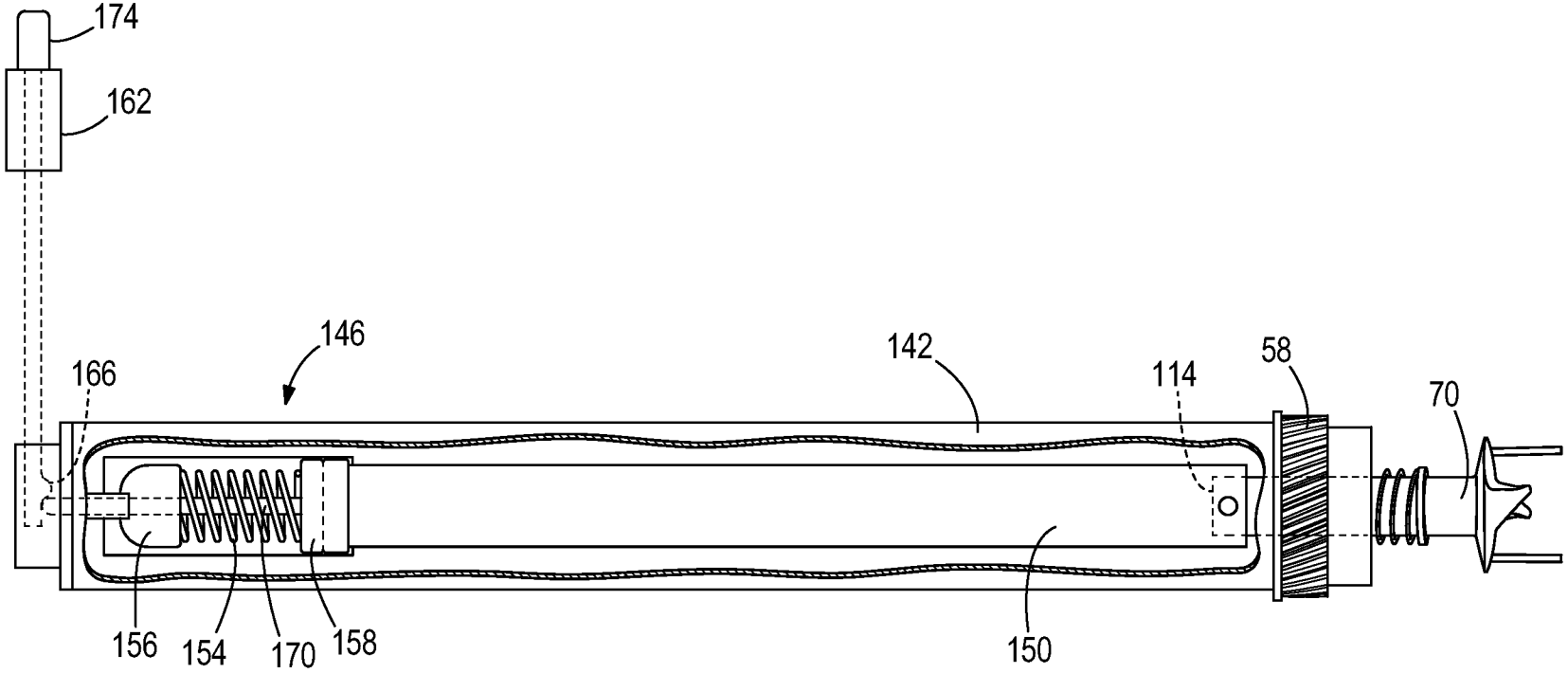
FIG. 8 is a side view of the drive receiving assembly attached to an imaging drum, with a portion of the drum cut away to reveal a first retracting mechanism.

Referring now to FIG. 8, the drive assembly 54 is shown installed into one end of an organic photo conductor or OPC drum 142 that forms part of a laser print cartridge. In some instances, it may become difficult to remove the print cartridge from the printer once the drive lugs 90 of the coupling member 70 are engaged with the printer drive system 10. To facilitate removal of the print cartridge, the drive assembly 54 may optionally be provided with an actuator 146 that functions to initiate movement of the coupling member 70 from the extended position to the retracted position, thereby disengaging the drive lugs 90 from the drive pin 22. In some embodiments the retraction mechanism may function to fully move the coupling member 70 from the extended position to the retracted position, to initiate movement of the coupling member 70 from the retracted position to the extended position, and/or to fully move the coupling member 70 from the retracted position to the extended position. In some embodiments, the actuator 146 may eliminate the need for the spring 82 and/or the cam surface 122 and the coupled axial and rotational movement that the cam surface 122 provides.

The actuator 146 of FIG. 8 is a mechanical actuator that selectively applies a rotational force to the coupling member 70 in a direction that causes the drive lugs 90 to disengage from the pin members 38 of the printer drive pin 22. The illustrated actuator 146 includes a torque tube 150 having one end non-rotatably coupled to the inner portion 74 of the coupling member 70. The other end of the torque tube 150 is coupled to a clutch mechanism 158, which in turn is coupled to a torsional energy storage device in the form of a spring 154. The other end of the spring 154 is coupled to a spring mount 156 that is rotatable relative to the OPC drum 142 but that is fixed relative to the remainder of the print cartridge 165. The OPC drum 142 therefore rotates around the spring mount 156 during printer operation. The clutch mechanism 158 is operable to regulate the storing and releasing of torsional energy from the spring 154. In the embodiment of FIG. 8, the torque tube 150, spring 154, and clutch mechanism 158 are all located within the OPC drum 142. Accordingly, the actuator 146 is located within an imaginary cylinder extending in the axial direction and defined by an outer diameter of the flange member 58.

Figure 9:
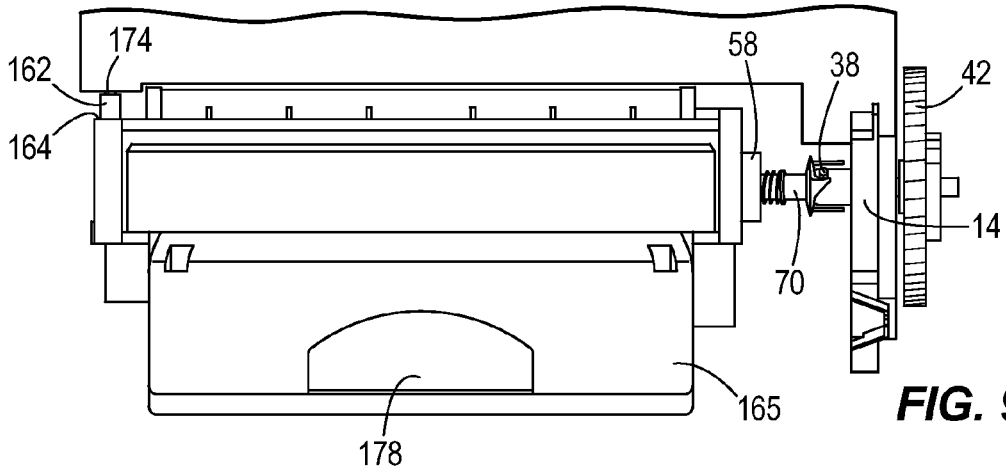
FIG. 9 is a top view of an imaging cartridge installed in a printer with the drive receiving assembly in the extended position.
Figure 10:
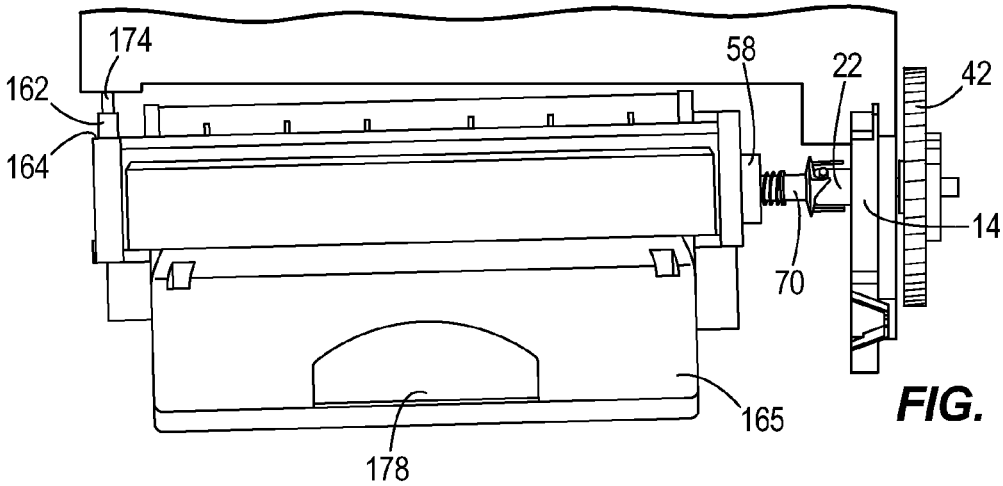
FIG. 10 is a top view similar to FIG. 9 just after a user attempts to remove the cartridge with the drive receiving assembly still in the extended position.
Figure 11:
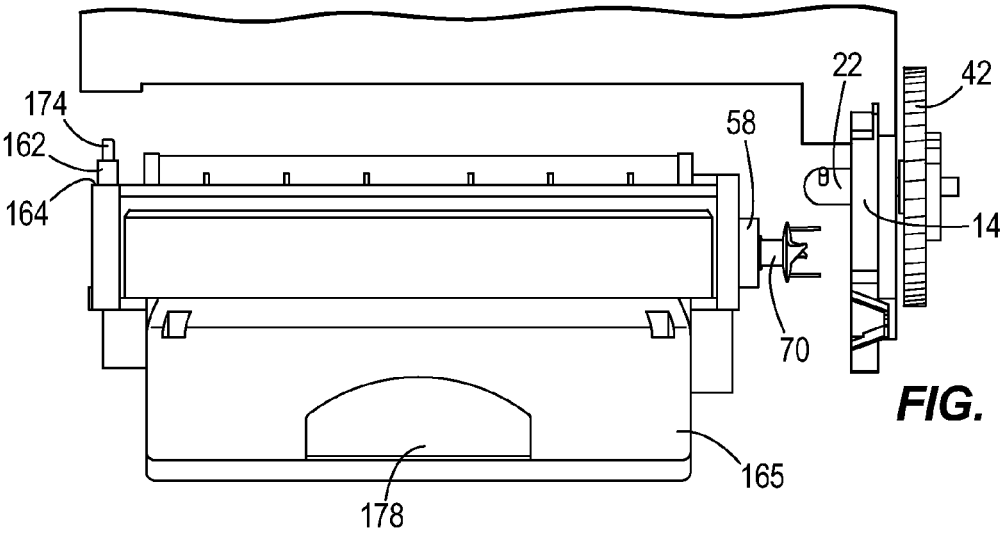
FIG. 11 is a top view similar to FIGS. 9 and 10 showing the drive receiving assembly in the retracted position and thereby allowing full removal of the cartridge.

Referring also to FIGS. 9-11, the clutch mechanism 158 is operably coupled to a trigger device 162 mounted on an exterior surface 164 of a print cartridge 165. The illustrated trigger device 162 is mechanical in nature and includes a cam surface 166 that is engageable with an actuation member 170 of the clutch mechanism 158 to engage and disengage the clutch mechanism 158. The cam surface 166 is operably coupled to push button 174 that is depressed when the print cartridge 165 is installed into the printer (FIG. 9) and released as the print cartridge 165 is removed from the printer (FIGS. 10-11). Movement of the push button 174 moves the cam surface 166 to operate the clutch mechanism 158.

In operation, the actuator 146 is installed in the OPC drum 142 with the spring 154 pre-loaded to store torsional energy. The spring 154 may be preloaded by an amount sufficient to perform several retractions of the coupling member 70 to accommodate repeated attempts to remove the print cartridge 165 from the printer over the expected life of the print cartridge 165. When the cartridge 165 is installed in the printer the push button 174 is depressed (FIG. 9) and the clutch mechanism 158 is disengaged such that the torque tube 150 can freely rotate relative to the spring 154 and the spring mount 156. As the printer operates to rotate the drive assembly 58 and the OPC drum 142, the spring mount 156, the spring 154, and the disengaged portion of the clutch mechanism 158 remain fixed with respect to the exterior surface 164 print cartridge 165.

The print cartridge 165 includes a handle 178 that facilitates removal of the cartridge 165 from the printer. When a user attempts to remove the print cartridge 165 by pulling on the handle 178, engagement between the coupling member 70 and the drive pin 22 restricts outward movement of that end of the print cartridge 165 (the right end in FIGS. 9-11) causing the cartridge 165 to assume a tilted or angled orientation with respect to the printer (FIG. 10). Because the trigger device 162 is mounted on the opposite side of the print cartridge 165 as the coupling member 70, the angled orientation of the cartridge 165 allows the push button 174 to extend. When the push button 174 extends the cam surface 166 and actuator member 170 cooperate to both engage the clutch mechanism 158 and release a predetermined amount of torsional energy from the spring 154. This torsional energy is transferred through the clutch mechanism 158 as rotational motion to the torque tube 150, which in turn causes rotation of the coupling member 70 in a direction that disengages the drive lugs 90 from the pin members 38 of the drive pin 22. By way of the cam surface 122, this rotation also causes the coupling member 70 to move from the extended position to the retracted position. Accordingly, and with reference to FIG. 7, the spring 154, clutch mechanism 158, and torque tube 150 cooperate to move the pin 118 from the flat portion 134 of the cam surface 122 to the detent portion 126 of the cam surface 122, thereby moving the coupling member from the extended and second rotational positions to the retracted and first rotational positions. Once the coupling member 70 is moved to the retracted position the cartridge 165 may be fully removed from the printer (FIG. 11). Because the coupling member 70 is in the retracted and first rotational positions with the pin 118 in the detent portion 126 of the cam surface 122, the cartridge 165 may be reinstalled into the printer thereby causing the coupling member 70 to re-engage the drive pin 22 in the manner described above.

Figure 12:
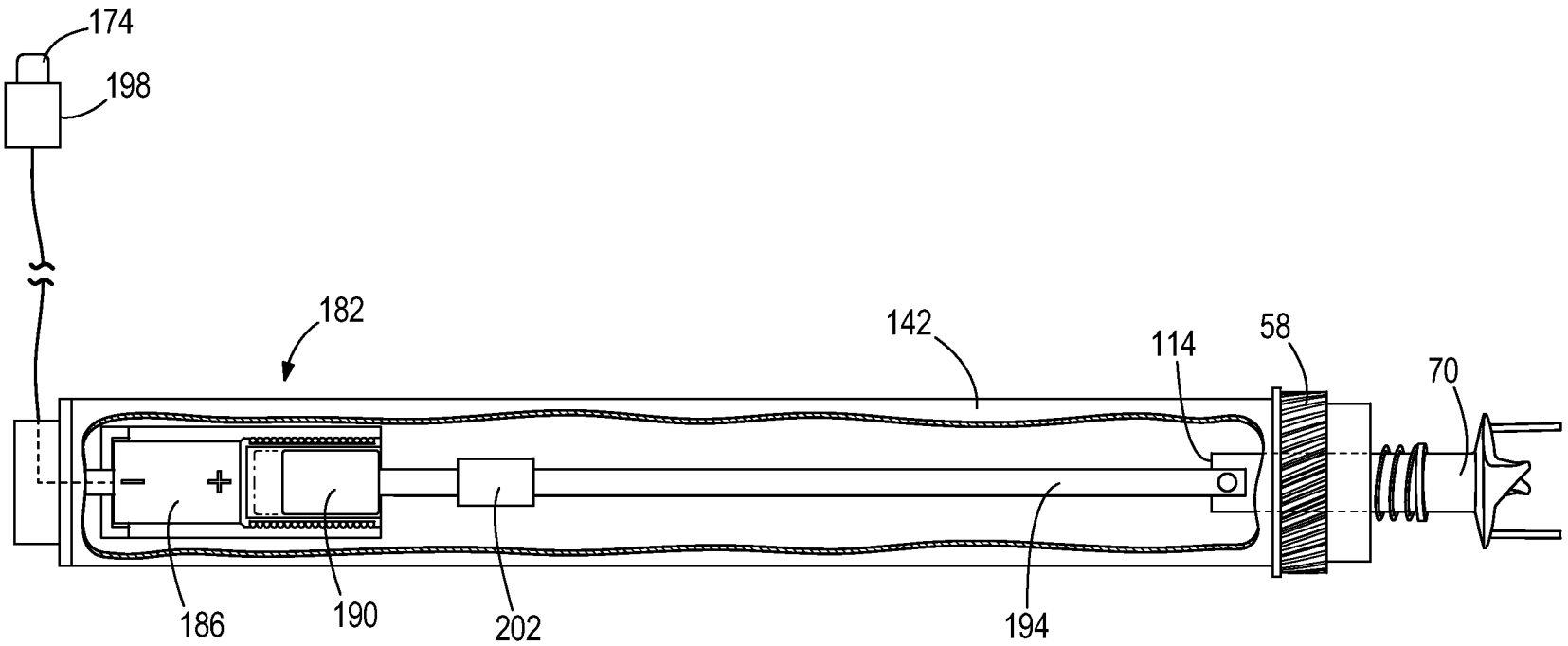
FIG. 12 is a side view of the drive receiving assembly attached to an imaging drum, with a portion of the drum cut away to reveal a second retracting mechanism.

FIG. 12 illustrates an alternative actuator 182 for initiating movement of the coupling member 70 at least from the extended position to the retracted position. The actuator 182 may also function to initiate movement of the coupling member from the retracted position to the extended position, and/or to fully move the coupling member between the extended position and the retracted position. The actuator 182 of FIG. 12 is electrically operable and includes a power supply 186 such as a battery and/or a capacitor, a prime mover such as a solenoid 190 or other actuation device, and a coupling rod 194 extending between the solenoid 190 and the coupling member 70. In the embodiment of FIG. 12, the coupling rod 194, solenoid 190, and power supply 186 are all located within the OPC drum 142. Accordingly, the actuator 182 is located within an imaginary cylinder extending in the axial direction and defined by an outer diameter of the flange member 58.

The actuator 182 is operably coupled to an electrically operated trigger device 198 mounted on the exterior surface 164 of the print cartridge 165 (FIGS. 9-11). The illustrated trigger device 198 is similar to the trigger device 162 and includes a push button 174 that may be depressed when the print cartridge 165 is installed in the printer. In other embodiments, the trigger device 198 may be operably coupled to or otherwise associated with one or more electrical contacts (not shown) provided on the print cartridge. As generally understood by those skilled in the art, printer cartridges containing OPC drums 142 are provided with a plurality of electrical contacts that engage corresponding contacts provided in the printer such that the printer can apply appropriate electrical potentials to various components throughout the printer cartridge. In some embodiments, the trigger device 198 associated with the actuator 182 may be configured to detect the presence or absence of the various electrical potentials provided by the printer that correspond to the installation or removal of the print cartridge from the printer. In this regard, the trigger device 198 may be configured to provide or detect at least one of an open circuit, a closed circuit, and a predetermined electrical potential in order to regulate or control operation of the actuator 182 in response to installation and removal of the cartridge.

The actuator 182 may be configured to provide linear or rotary actuation. If a linear actuator is provided, it may be configured such that when the cartridge 165 is installed in the printer and the trigger device 198 detects such installation, the solenoid 190 operates to move the coupling member 70 from the retracted position to the extended position for engagement with the drive pin 22. In this instance, the catch members 98, the cam surface 122, the spring 82, and related structure for moving the coupling member 70 from the retracted position to the extended position may be eliminated. The linear-type actuator 182 may further be configured such that when the trigger device 198 detects that a user is attempting to remove the cartridge 165, for example because the cartridge takes the position shown in FIG. 10, the solenoid 190 operates to move the coupling member 70 from the extended position to the retracted position.

In other embodiments, the solenoid 190 may be a rotary-type solenoid that operates to rotate the coupling member 70 relative to the flange member 58. In this instance the solenoid 190 operates similarly to the spring 154 and causes the pin 118 to move along the cam surface 122 to achieve movement of the coupling member from the extended position to the retracted position and from the second rotational position to the first rotational position.

If the actuator 182 is a linear-type actuator, the actuator 182 may be fixed relative the exterior surface 164 of the print cartridge 165, or may rotate with the OPC drum 142. If the actuator 182 is fixed with respect to the exterior surface 164 of the print cartridge 165, a rotary coupling 202 is provided between the solenoid 190 and the coupling member 70, for example at a location along the coupling rod 194, as shown in FIG. 12. If the actuator 182 is configured to rotate with the OPC drum 142, a rotatable electrical coupling, such as a slip ring (not shown) may be provided between the trigger device 198 and the actuator 182. In some embodiments, rotation of the OPC drum 142 may be used to charge the power supply 186, regardless of whether the power supply is a capacitor, a battery, or some combination thereof.

Various features and advantages of the invention are set forth in the following claims.

What is claimed is:

1. A drive receiving member for transferring rotational driving force from an image forming apparatus to components of an imaging cartridge, the member comprising:

a central portion defining an axis;

a plane extending through the central portion substantially perpendicular to the axis; and a distal end for receiving rotational driving force, the distal end including at least one substantially rigid drive lug defining a drive-receiving surface and including a drive lug end positioned a first axial distance from the plane, and at least one resilient catch member including a catch member end positioned a second axial distance from the plane, wherein the second axial distance is greater than the first axial distance.

2. The member of claim 1, wherein the at least one substantially rigid drive lug includes a pair of substantially diametrically opposed substantially rigid drive lugs, and wherein the drive lug end of each of the pair of drive lugs is positioned the first axial distance from the plane.

3. The member of claim 2, wherein the at least one resilient catch member includes a pair of substantially diametrically opposed resilient catch members, and wherein the catch member end of each of the pair of catch members is positioned the second axial distance from the plane.

4. The member of claim 1, wherein the central portion includes an axially facing retention surface, and wherein the retention surface defines the plane.

5. The member of claim 4, wherein the retention surface receives a biasing force that biases the drive receiving member axially toward the distal end.

6. The member of claim 1, wherein the catch member is circumferentially spaced from the drive-receiving surface.

7. The member of claim 1, further comprising a proximal end including a radially outwardly extending projection defining a drive-transmitting surface.

8. The member of claim 1, wherein the drive lug includes a drive lug base and the catch member includes a catch member base, and wherein the drive lug base and the catch member base are spaced a third axial distance from the plane.

9. A drive receiving assembly for transferring rotational driving force from an image forming apparatus to components of an imaging cartridge, the assembly comprising:

a generally cylindrical flange member defining an axis;

an elongated coupling member coupled to the flange member for axial movement with respect thereto between an extended position and a retracted position, the coupling member including a distal end having a substantially rigid drive lug extending a first axial distance away from the flange member and a resilient catch member extending a second axial distance away from the flange member; and a biasing member positioned between the flange member and the coupling member and biasing the coupling member toward the extended position.

10. The assembly of claim 9, wherein the coupling member includes a proximal end including a radially outwardly extending projection defining a drive-transmitting surface, wherein the flange member includes a drive dog, and wherein the drive-transmitting surface engages the drive dog to transfer rotational driving force from the coupling member to the flange member.

11. The assembly of claim 9, wherein the coupling member is rotatable about the axis relative to the flange member between a first rotational position and a second rotational position.

12. The assembly of claim 11, further comprising a cam surface for regulating movement of the coupling member relative to the flange member such that when the coupling member is moved from the first rotational position to the second rotational position the coupling member moves from the retracted position to the extended position.

13. The assembly of claim 12, wherein the cam surface includes a detent portion detently securing the coupling member in the first rotational position and in the retracted position.

14. The assembly of claim 13, wherein when the detent portion is overcome, the biasing member moves the coupling member to the extended position.

15. The assembly of claim 12, wherein the cam surface includes a flat portion that affords a limited range of rotational movement between the coupling member and the flange member while the coupling member is in the extended position.

16. The assembly of claim 12, wherein the cam surface is provided on the flange member.

17. The assembly of claim 16, wherein the coupling member includes a pin member that rides along the cam surface during movement of the coupling member from the first rotational position to the second rotational position.

18. A drive receiving assembly for transferring rotational driving force from an image forming apparatus to components of an imaging cartridge, the assembly comprising:

a flange defining an axis and including an outer diameter defining an imaginary cylinder extending in the axial direction;

a coupling member coupled to the flange for axial movement with respect to the flange between an extended position and a retracted position; and an actuator located within the imaginary cylinder and operable to initiate movement of the coupling member from the extended position toward the retracted position.

19. The assembly of claim 18, further comprising a biasing member biasing the coupling member toward the extended position.

20. The assembly of claim 19, wherein the coupling member is rotatable about the axis relative to the flange member between a first rotational position and a second rotational position.

21. The assembly of claim 20, further comprising a cam surface for regulating movement of the coupling member relative to the flange member such that when the coupling member is moved from the second rotational position to the first rotational position the coupling member moves from the extended position to the retracted position.

22. The assembly of claim 21, wherein the actuator is a rotary actuator that rotates the coupling member from the second rotational position to the first rotational position, thereby overcoming the biasing member and moving the coupling member from the extended position to the retracted position.

23. The assembly of claim 18, wherein the actuator is operable to move the coupling member between the extended position and the retracted position.

24. The assembly of claim 18, further comprising a trigger engageable with a portion of the image forming apparatus, wherein the trigger activates the actuator upon disengagement from the portion of the image forming apparatus.

* * * * *